US007380528B2

(12) United States Patent
Gaessler et al.

(10) Patent No.: US 7,380,528 B2
(45) Date of Patent: Jun. 3, 2008

(54) METHOD FOR OPERATING A HYDRAULIC ACTUATOR, ESPECIALLY A GAS EXCHANGE VALVE OF AN INTERNAL COMBUSTION ENGINE

(75) Inventors: Hermann Gaessler, Vaihingen (DE); Ulf Pischke, Stuttgart (DE); Hubert Schweiggart, Stuttgart (DE); Christian Grosse, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 189 days.

(21) Appl. No.: 10/547,190

(22) PCT Filed: Oct. 6, 2003

(86) PCT No.: PCT/DE03/03305

§ 371 (c)(1),
(2), (4) Date: May 4, 2006

(87) PCT Pub. No.: WO2004/081350

PCT Pub. Date: Sep. 23, 2004

(65) Prior Publication Data

US 2006/0241846 A1 Oct. 26, 2006

(30) Foreign Application Priority Data

Mar. 10, 2003 (DE) ..... 10 310 3007

(51) Int. Cl.
*F01L 9/02* (2006.01)

(52) U.S. Cl. ..... 123/90.12; 123/90.15; 123/90.19; 251/129.03

(58) Field of Classification Search ..... 123/90.12
See application file for complete search history.

(56) References Cited

U.S. PATENT DOCUMENTS

| | | | | |
|---|---|---|---|---|
| 6,321,703 | B1 * | 11/2001 | Diehl et al. | 123/90.12 |
| 6,739,293 | B2 * | 5/2004 | Turner et al. | 123/90.12 |
| 6,779,496 | B2 * | 8/2004 | Gaessler et al. | 123/90.14 |
| 6,848,400 | B2 * | 2/2005 | Gaessler et al. | 123/90.12 |

FOREIGN PATENT DOCUMENTS

| | | |
|---|---|---|
| DE | 42 18 320 | 12/1993 |
| DE | 198 26 047 | 12/1999 |
| DE | 199 63 753 | 7/2001 |
| DE | 101 38 777 | 2/2003 |
| EP | 0 915 236 | 5/1999 |
| RU | 1 700 287 | 12/1991 |

* cited by examiner

*Primary Examiner*—Thomas Denion
*Assistant Examiner*—Kyle M Riddle
(74) *Attorney, Agent, or Firm*—Kenyon & Kenyon LLP

(57) ABSTRACT

In an hydraulic actuator, a movement of an actuating element of the actuator is effected in that a working chamber of the actuator, with the aid of a valve device, is able to be selectively connected to, and disconnected from, a fluid reservoir in which pressurized hydraulic fluid is stored. The lift of the actuating element of the actuator is a function of a fluid volume present in the working chamber. It is provided that, to ascertain an instantaneous operating performance of the actuator, the working chamber is briefly connected to the fluid reservoir, the corresponding pressure drop in the fluid reservoir is recorded, and the corresponding lift is determined from the pressure drop with the aid of known geometrical variables of the actuator.

12 Claims, 5 Drawing Sheets

METHOD FOR OPERATING A HYDRAULIC ACTUATOR, ESPECIALLY A GAS EXCHANGE VALVE OF AN INTERNAL COMBUSTION ENGINE

FIELD OF THE INVENTION

The present invention relates to a method for operating an hydraulic actuator, in particular for a gas-exchange valve of an internal combustion engine, in which a movement of an actuating element of the actuator is effected in that a working chamber of the actuator, by means of a valve device, is able to be connected to, and disconnected from, a fluid reservoir in which pressurized hydraulic fluid is stored, the lift of the actuating element of the actuator being a function of a fluid volume present in the working chamber.

BACKGROUND INFORMATION

Published German patent document DE 198 26, 047 describes a device for controlling a gas-exchange valve of an internal combustion engine and the corresponding operating method. A high-pressure pump pumps hydraulic fluid into a piping system in which the hydraulic fluid is stored under very high pressure. A working chamber of an hydraulic cylinder whose piston is connected to a valve element of a gas-exchange valve of an internal combustion engine is connected to the fluid reservoir via a two-way valve. An outlet of the working chamber is also connected to a low-pressure region via a two-way valve. Depending on the valve setting, high or low pressure prevails in the working chamber of the hydraulic actuator and a corresponding fluid volume is present in the working chamber, which affects the piston position.

The advantage of such a gas-exchange valve is that it may be triggered independently of a setting of a camshaft of the internal combustion engine. For cost reasons, no detection of the instantaneous piston position takes place. As a result, the positioning of the piston of the hydraulic actuator is not able to be precisely regulated.

An object of the present invention is to provide a method such that the actuating element of the actuator is able to be positioned as precisely as possible.

SUMMARY

In a method according to the present invention, this objective is achieved in that, to ascertain an instantaneous operating performance of the actuator, the working chamber is briefly connected to the fluid reservoir, the corresponding pressure drop in the fluid reservoir is recorded and the corresponding lift is ascertained from the pressure drop with the aid of known geometric variables of the actuator, and at least one value pair is formed, which is made up of an opening duration and the lift.

The ascertained value pair may be compared with a value pair determined on a test stand, for example, or during a previous method run. In this manner age manifestations, changed ambient conditions etc. may be detected and taken into account in the triggering of the valve devices. The outputting of an information when the instantaneous operating performance of the actuator has changed in an impermissible manner is possible as well. This increases the reliability of the actuator operation since it allows countermeasures to be taken even before the operation of the actuator possibly results in damage.

In a first example embodiment of the invention, it is provided that the pressure drop in the fluid reservoir be recorded for different durations during which the working chamber of the actuator is connected to the fluid reservoir and that an instantaneous characteristic curve be formed from the ascertained value pairs. In this case the actuating element of the hydraulic actuator may be positioned very precisely in normal operation without the need for complex regulation and the cost-intensive installation of a sensor that detects the lift of the actuating element of the hydraulic actuator. Therefore, the precise positioning of the actuating element is basically possible without additional hardware and, consequently, at low cost.

According to an example embodiment of the method according to the present invention, the actuating element is brought from a known initial position to a known limit position, the corresponding pressure drop in the fluid reservoir is recorded, and the at least one ascertained value pair is standardized with the aid of the recorded pressure drop and the lift between initial position and limit position. Measuring inaccuracies are able to be eliminated by this method and the precision of the characteristic curve of the hydraulic actuator may be improved even further. Due to the additional method step provided in this example embodiment, the actual method by which at least one value pair is determined is calibrated, so to speak.

The actuating element may be brought into the initial or the limit position simply in that the valve device is in one or the other position for a particular length of time. Alternatively or additionally, however, the reaching of the initial and/or the limit position of the actuating element may also be detected with the aid of a knock sensor. This improves the precision of the aforesaid standardization or calibration.

It is also provided that the at least one value pair be formed taking the elasticity module of the hydraulic fluid and/or the elasticity of the fluid reservoir into account. This, too, results in even greater precision of the instantaneous characteristic curve of the hydraulic actuator. In addition, it may also be taken into account that the elasticity module of the hydraulic fluid is temperature and pressure dependent. The elasticity of the fluid reservoir, too, i.e., the elasticity of its walls, may change, primarily as a function of the temperature.

In a further example embodiment of the method according to the present invention, it is also indicated that the temperature and/or the viscosity of the hydraulic fluid are/is recorded during the detection of the instantaneous operating performance of the actuator and the at least one value pair is formed for a particular viscosity and/or a particular temperature of the hydraulic fluid. Therefore, it is possible in this way to generate a whole set of value pairs or characteristic curves, one value pair or one characteristic curve in each case being valid only for quite specific operating or ambient conditions. This, too, ultimately results in an even further improvement of the precision of the positioning of the actuating element of the hydraulic actuator.

It is also advantageous if the response time of the valve device is ascertained from the onset of the pressure drop in the fluid reservoir. For the accuracy of the positioning of the actuating element of the hydraulic actuator, in particular with respect to the temporal accuracy, the response time—i.e., the time between the generation of the trigger signal and the onset of the pressure drop caused by the movement of the actuating element—is particularly important. In the method according to the present invention, this response time may be determined "as an aside", so to speak, and be taken into account in the triggering of the valve device during normal operation of the hydraulic actuator.

To determine the instantaneous operating performance of the hydraulic actuator, it is advantageous if the fluid reservoir is fluidly separated from a pressure reservoir, and/or a high-pressure pump for the supply of the fluid reservoir is de-energized. While the method according to the present invention may also be carried out when a pressure reservoir is connected to the fluid reservoir or when a high-pressure pump delivers into the fluid reservoir, these cases require fairly complex consideration of the form change of the pressure reservoir (for example by means of a position detection at the pressure reservoir) or the conveying capacity of the high-pressure pump. This will not be required if, as provided in the example embodiment, the fluid reservoir is simply separated from the pressure reservoir or from the high-pressure pump. Furthermore, this improves the precision of the method according to the present invention, since the volume of the fluid reservoir is reduced by this measure, which leads to a greater pressure drop in a corresponding triggering of the valve device at the same lift of the actuating element of the hydraulic actuator, the pressure drop being able to be measured with greater accuracy.

If the hydraulic actuator is used to activate a gas-exchange valve of an internal combustion engine, it is advantageous if the instantaneous operating performance is determined after the internal combustion engine has been shut off or during an overrun operation of the internal combustion engine. In this case the method according to the present invention may be carried out without adverse effect on the normal operation of the internal combustion engine.

However, it should be ensured that the triggering of the hydraulic actuator for the purpose of determining the instantaneous characteristic curve is implemented in such a way that the particular gas-exchange valve neither collides with a piston of the internal combustion engine nor with another gas-exchange valve. In overrun operation, for example, a triggering of the hydraulic actuator is consequently conceivable only in a partial lift range. Given a multi-cylinder internal combustion engine, it is thus possible that a plurality of de-energize phases are required to ascertain the instantaneous operating performance of the actuators of all gas-exchange valves.

Furthermore, it may be provided according to the present invention that the pressure in the fluid reservoir be recorded when the hydraulic actuator is at rest and a report be output in the case of an impermissible pressure drop. This allows the tightness or the leakage of the hydraulic system of the fluid reservoir supplying the actuator to be checked. In this way, the user may detect the availability of the correct operating mode of the hydraulic actuator and thus ultimately of the gas-exchange valve; if warranted, the operation of the internal combustion engine may be terminated automatically or be restricted to a safety zone so as to avoid damage to the internal combustion engine due to an incorrectly working gas-exchange valve. It is understood that the monitoring of the pressure drop is facilitated if a high-pressure pump, which supplies the fluid reservoir with hydraulic fluid, is switched off or is completely disconnected from the fluid reservoir. The same also holds for a pressure reservoir.

The present invention also provides a computer program, which is programmed to carry out the afore-described method and is stored on a computer-readable storage medium.

The present invention also provides a control and/or regulating device for an internal combustion engine, which is programmed to be used in the above-described method.

The present invention also provides an internal combustion engine, in particular for a motor vehicle, having a control and/or regulating device, which is programmed to be used in the above-described method.

DETAILED DESCRIPTION

Figure 1:
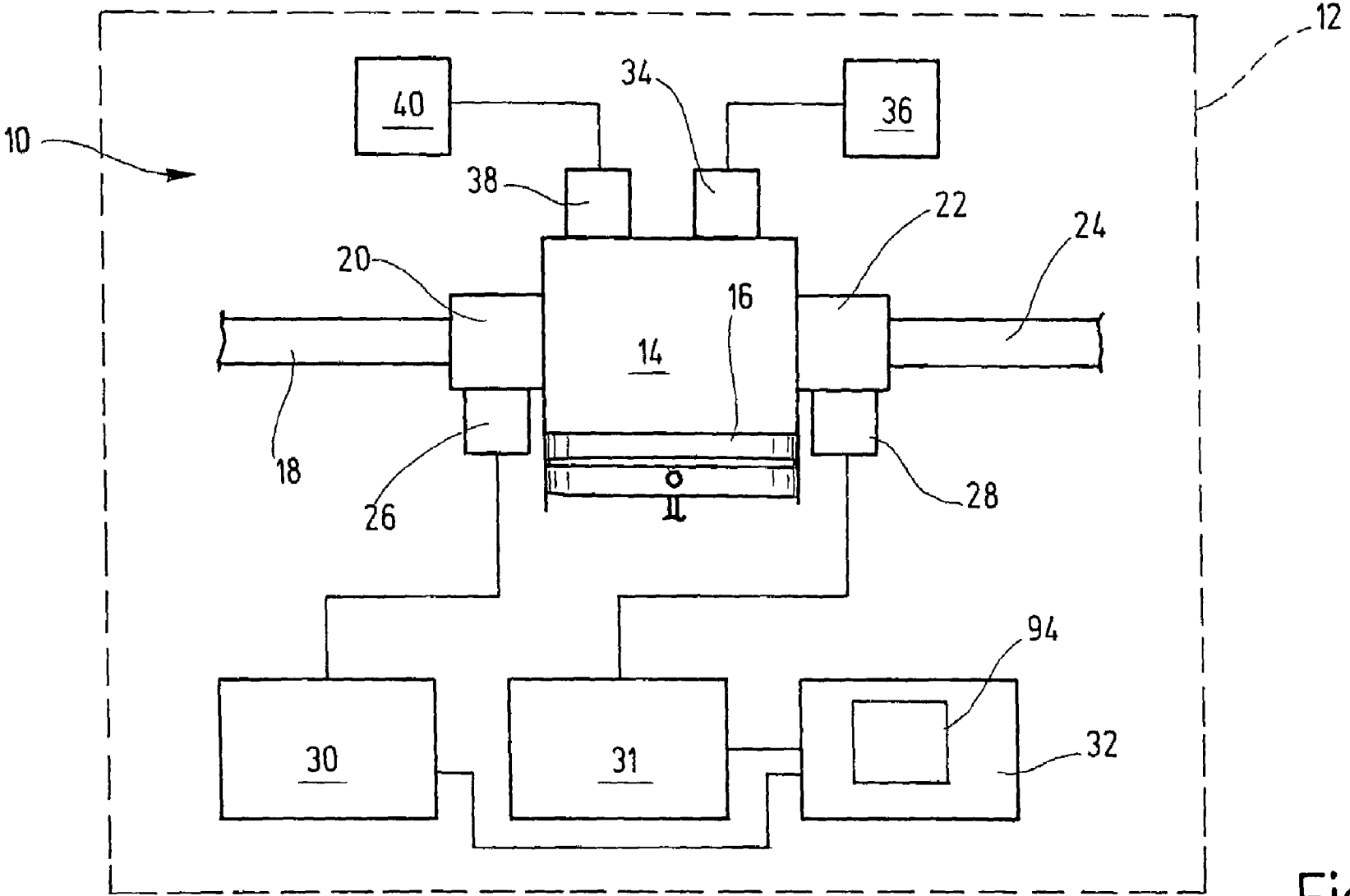
FIG. 1 shows a schematic illustration of an internal combustion engine of a motor vehicle having gas-exchange valves, which are activated by an hydraulic actuator connected to an hydraulic system.

In FIG. 1, an internal combustion engine is generally denoted by reference numeral 10. It is used to drive a motor vehicle 12, which is shown only symbolically in FIG. 1, using a dashed line. Internal combustion engine 10 is a multi-cylinder internal combustion engine having reciprocating pistons. However, for reasons of clarity, only the essential elements of a single cylinder are shown in FIG. 1.

The cylinder shown in FIG. 1 includes a combustion chamber 14, which is delimited by a piston 16 among others. Air is supplied to combustion chamber 14 via an inflow pipe 18 and a first gas-exchange valve 20. First gas-exchange valve 20 thus is the intake valve of combustion chamber 14. The combustion waste gases are conducted from combustion chamber 14 to an exhaust-gas pipe 24 via a second gas-exchange valve 22. The second gas-exchange valve thus is a discharge valve of combustion chamber 14.

In internal combustion engine 10 shown in FIG. 1, intake valve 20 and discharge valve 22 are not activated by a camshaft but by an hydraulic actuator 26 or 28, respectively. Hydraulic actuator 26 is triggered by an hydraulic system 30, and actuator 28 is triggered by an hydraulic system 31 whose exact configuration is discussed in greater detail at a later point. Hydraulic systems 30 and 31 are in turn controlled by a control device 32.

The fuel arrives in combustion chamber 14 of internal combustion engine 10 via an injector 34, which injects the fuel directly into combustion chamber 14. Injector 34 is connected to a fuel system 36. The fuel-air mixture present in combustion chamber 14 is ignited by a spark plug 38, which is controlled by an ignition system 40. Elements 38 and 40 may be dispensed with in a diesel gasoline engine.

Hydraulic systems 30 and 31 are identically configured. They will now be discussed on the basis of hydraulic system 30 according to FIG. 2:

Hydraulic fluid (not shown) is stored in a storage reservoir 42. An adjustable high-pressure pump 44, which is driven by an electric motor 46, supplies the hydraulic fluid out of storage reservoir 42 into a high-pressure line 50, via a one-way valve 48. Connected to high-pressure line 50 is a pressure reservoir 52, which may be, for instance, a pressure reservoir having a spring-loaded piston. A pressure sensor 54 detects the pressure in high-pressure line 50 and transmits corresponding signals to control device 32.

Hydraulic actuator 26 is a two-way hydraulic cylinder. A piston 58 is arranged in a housing 56 in a movable manner. A fluid chamber between the upper face of piston 58 (here and hereinafter, "upper" and "lower" refer only to the representation in the figures) and housing 56 forms a first working chamber 60. A fluid chamber between the bottom side of piston 58, a piston rod 62 being connected thereto, and housing 56 form a second working chamber 64. Braced between the bottom side of piston 58 and housing 56 is a compression spring 66. Piston rod 62 is connected to intake valve 20.

Between hydraulic actuator 26 and pressure sensor 54 is a storage chamber 68 in high-pressure line 50, which forms a collection line in the sense of a "high-pressure rail". Via a branch line 70, second working chamber 64 is permanently connected to high-pressure line 50 or storage chamber 68. Arranged between storage chamber 68 and first working chamber 60 is a two-way valve 72, which is closed in its spring-loaded rest position 74 and open in its activated position 76 (two-way valve 72 is activated by an electromagnet 78). High-pressure line 50, pressure reservoir 52, storage chamber 68, branch line 70 and second working chamber 64 together form a fluid reservoir 80, which is sealed in the direction of high-pressure pump 44 by one-way valve 48 and may be sealed with respect to first working chamber 60 by valve 72.

First working chamber 60 is connected to storage reservoir 42 by a return line 82. A two-way valve 84 and a one-way valve 86 are arranged in return line 82. Two-way valve 84 is open in its spring-loaded rest position 88 and closed in activated position 90. It is brought into closed position 90 by an electromagnet 92.

In normal operation of the internal combustion engine, a back-and-forth movement of intake valve 20 is effected by an alternating activation of the two solenoid valves 72 and 84. When solenoid valve 84 is closed, the opening duration of solenoid valve 72 determines how much hydraulic fluid reaches working chamber 60 of hydraulic actuator 26. The quantity of hydraulic fluid present in first working chamber 60 in turn determines the position or the lift of piston 58 and thus ultimately the lift of intake valve 20 as well. Intake valve 20 is closed by opening solenoid valve 84 when solenoid valve 72 is closed.

To ascertain the instantaneous operating performance of hydraulic actuator 26, a method is used that is stored as computer program in a memory 94 of control device 32. The method will now be explained with reference to FIG. 3:

Following a start block 96, high-pressure pump 44 is switched off in a block 98. Magnets 78 and 92 of both solenoid valves 72 and 84 are de-energized in same block 98. Solenoid valve 72 is thus closed whereas solenoid valve 84 is open. This pushes piston 58 into its upper limit position in FIG. 2. In block 100, solenoid valve 84 is then brought into its closed position 90. In a block 102, solenoid valve 72 is opened during a defined time period dt and then closed again. Pressure sensor 54 detects pressure drop dp in fluid reservoir 80 (block 104). This pressure drop, together with corresponding time period dt, is stored as value pair dp,dt.

Figure 2:
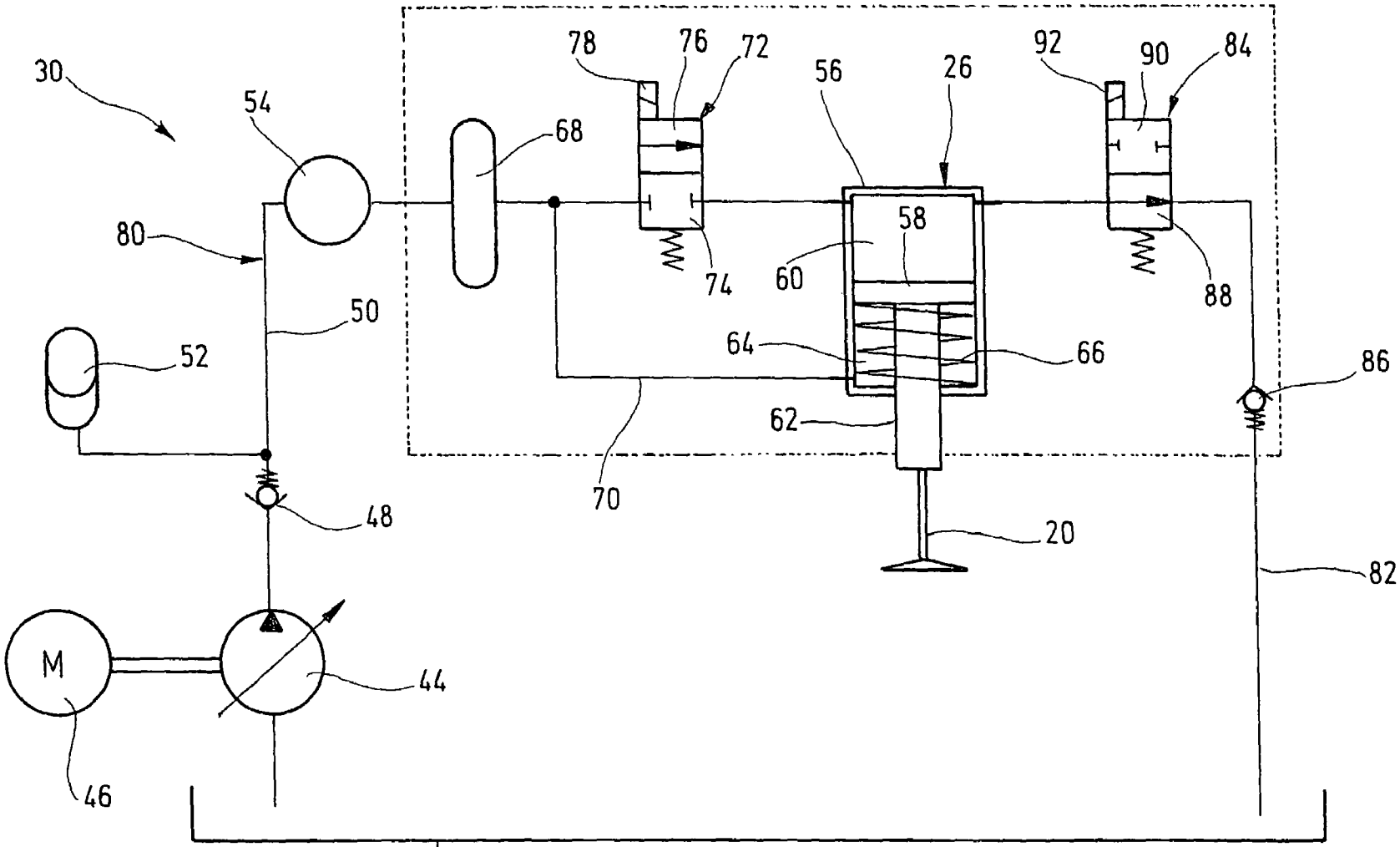
FIG. 2 shows a more detailed representation of the hydraulic system of FIG. 1.

In a block 106 it is queried whether piston 58 has moved to its lower limit position shown in FIG. 2. This is detected by a knock sensor, which is not shown in FIGS. 1 and 2. If the answer in block 106 is "no", solenoid valve 84 is opened in block 108 and then closed again. This relieves first working chamber 60, and piston 58 reaches its upper initial position in FIG. 2 again. In a time block 110, time period dt is increased by a fixed differential value dt1. A return to block 102 then takes place.

Figure 3:
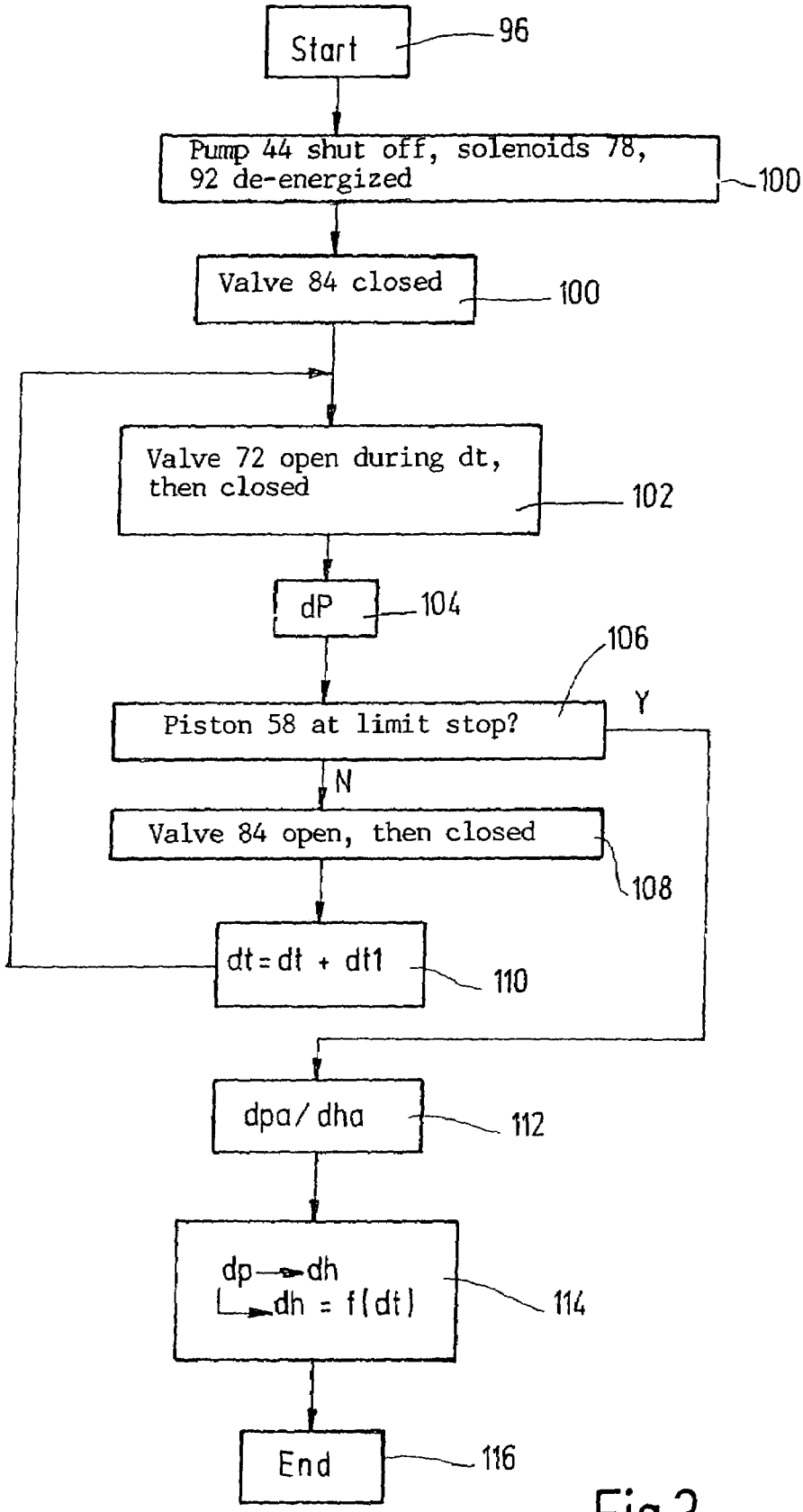
FIG. 3 shows a flow chart illustrating a method for operating the hydraulic actuator of FIG. 1.

Using the method shown in FIG. 3, solenoid valve 72 is thus opened successively during an increasingly longer period of time, so that a correspondingly larger quantity of hydraulic fluid flows out of fluid reservoir 80 into first working chamber 60 and a correspondingly different pressure drop is recorded by pressure sensor 54. It is to be understood in this context that a pressure drop at pressure sensor 54 is detected only when pressure reservoir 52 is blocked, for instance. If this is impossible, the state change of pressure reservoir 52 would also have to be detected as an alternative.

The method loop is run through repeatedly until piston 58 has reached its lower limit stop shown in FIG. 2. In this case, a switch is made from block 106 to block 112 in which the quotient is formed from pressure drop dpa and the corresponding maximum lift dha between the upper limit stop and the lower limit stop of piston 58.

The corresponding lifts of piston 58 are calculated in block 114 of FIG. 3 from the stored pressure differentials dp. The following formula is used $$dh = \frac{\frac{VO * dp}{E_{OIL}}}{dA}$$

In the above formula, dh is the lift of piston 58; VO the original volume in fluid reservoir 80 prior to the opening of solenoid valve 72; dp the pressure drop detected by pressure sensor 54; $E_{OIL}$ the elasticity of the hydraulic fluid; and dA the difference between the upper and the lower boundary surfaces of piston 58. In this manner, value pairs dp,dh are formed from which, furthermore, a characteristic curve dh=f(dt) is formed in block 114 of FIG. 3. This characteristic curve links lift dh of piston 58 to corresponding opening duration dt of solenoid valve 72. This characteristic curve is then utilized in normal operation to trigger solenoid valve 72 so as to achieve a certain desired lift. Value pairs dp,dh are standardized or calibrated on the basis of quotient dpa/dha formed in block 112 of FIG. 3.

Figure 4:
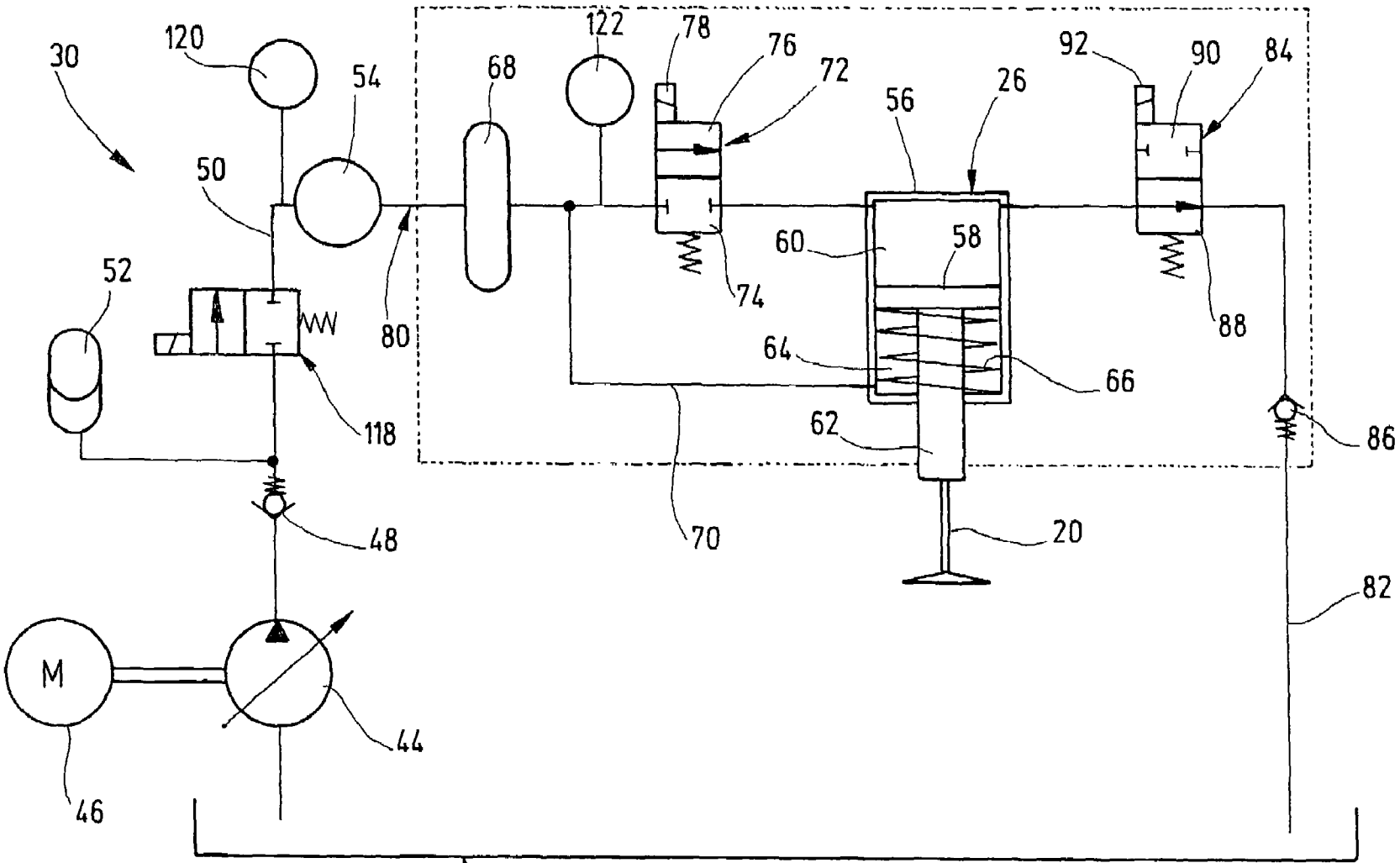
FIG. 4 shows a schematic illustration of an alternative exemplary embodiment of an hydraulic system.
Figure 5:
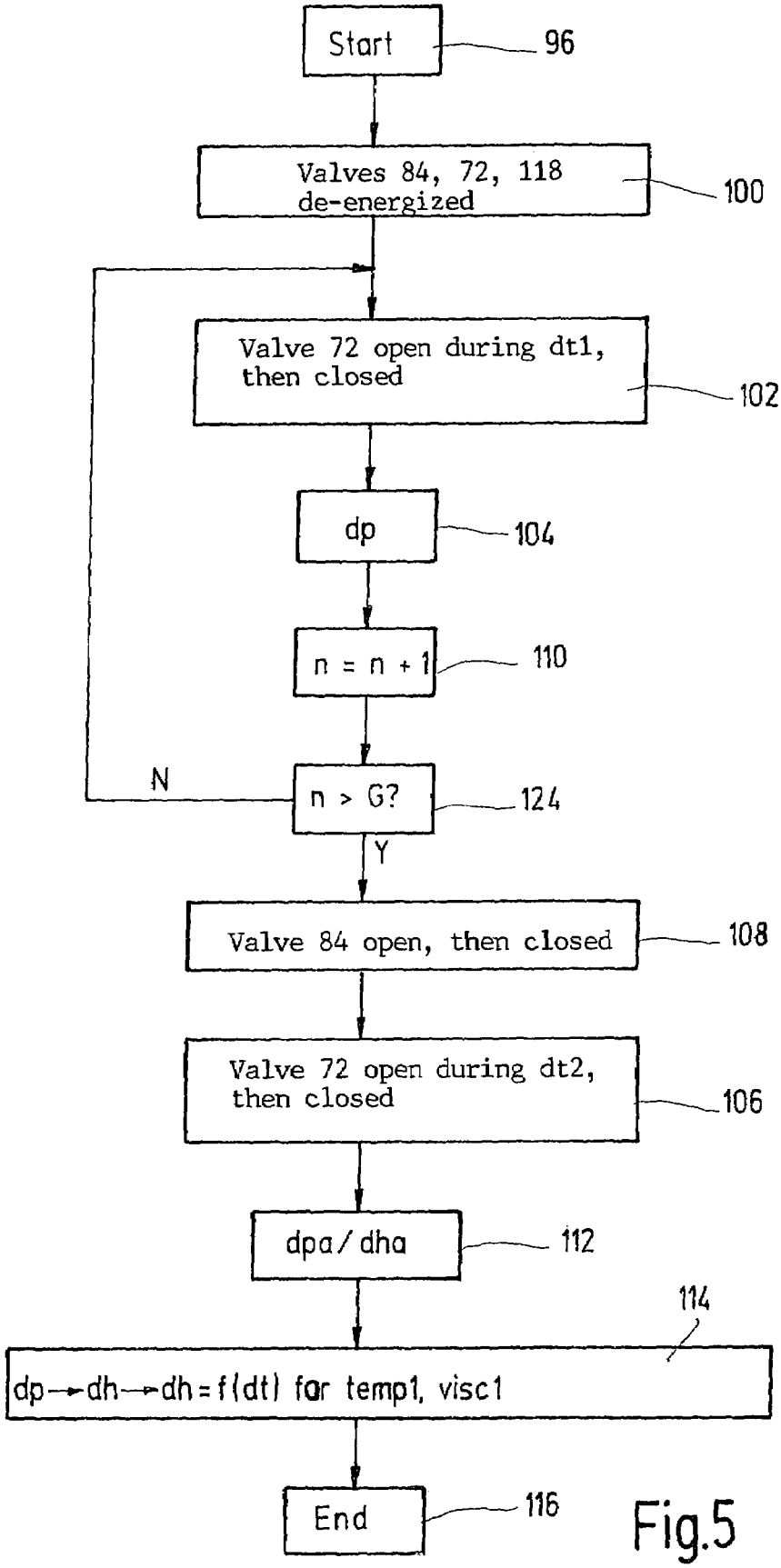
FIG. 5 shows a flow chart of a method for operating the hydraulic actuator of FIG. 1 using the hydraulic system of FIG. 4.

With reference to FIGS. 4 and 5, a second exemplary embodiment of an hydraulic system 30 will now be discussed. Those elements and function blocks that have functions which are equivalent to those of elements and function blocks of the exemplary embodiment described in connection with FIGS. 2 and 3 have the same reference numerals and are not discussed again in detail.

First of all, hydraulic system 30 shown in FIG. 4 differs from that in FIG. 2 by an additional solenoid valve 118, which is arranged between one-way valve 48 and pressure reservoir 52 on one side, and pressure sensor 54 on the other side. With the aid of additional solenoid valve 118, it is thus possible to separate fluid reservoir 80 from pressure reservoir 52, which facilitates the detection of pressure drop dp. Also provided in hydraulic system 30 shown in FIG. 4 are a temperature sensor 120 and a viscosity sensor 122, which record the temperature and the viscosity, respectively, of the hydraulic fluid present in fluid reservoir 80 and transmit corresponding signals to control device 32.

The instantaneous operating performance of hydraulic actuator 26 of FIG. 4 is determined by means of a method which will now be discussed with reference to FIG. 5:

In contrast to the method of FIG. 3, valve 118 is also de-energized in block 100 in the method illustrated in FIG. 5. This, as already mentioned earlier, separates pressure reservoir 52 from fluid reservoir 80, and high-pressure pump 44, too, is separated from fluid reservoir 80. If appropriate, it may also continue running while the method illustrated in FIG. 5 is executed.

In block 102, valve 72 is opened during a plurality of method loops during a same time period dt1. That is to say, it is opened further and further in a step-wise manner. In block 110, a counter n is incremented by 1 in each case, and in block 124 it is queried whether counter n is greater than a limit value G. Limit value G thus restricts the number of measuring procedures to a fixed value. In block 106, valve 72 is opened during a time period dt2, which is long enough for piston 58 to attain its lower limit position in FIG. 4 under all circumstances. As a result, this procedure will not have to be detected by a knock sensor. In block 114, characteristic curve dh=f(dt) is determined and stored for temperature temp1 recorded by temperature sensor 120 and viscosity visc1 of the hydraulic fluid recorded by viscosity sensor 122. If the method of FIG. 5 is run through under different ambient conditions, a set of characteristic curves is produced, each of which is suited to particular ambient conditions.

The methods illustrated in FIGS. 3 and 5 may be initiated by control device 32 immediately after internal combustion engine 10 has been shut off. Control device 32 is aware of the position of pistons 16 of the individual cylinders of internal combustion engine 10, and the methods illustrated in FIGS. 3 and 5 will be implemented only for those cylinders for which it is ensured that no collision will occur between intake valve 22 and corresponding piston 16 or with other valves. If the methods are implemented with a certain regularity after the internal combustion engine has been shut off, it is nevertheless ensured that the instantaneous operating performance of hydraulic actuators 26 of intake valves 20 of all cylinders is known. However, it is also possible to implement the methods during an overrun operation of the motor vehicle as long as it is ensured that no collisions will occur between the piston and the corresponding gas-exchange valve.

In an analogous manner, the instantaneous operating performance of hydraulic actuators 28 of discharge valves 22 is determined as well. It may also be considered here that collisions may occur between intake valve 20 and discharge valve 22 of a cylinder. In a repeated implementation of the methods shown in FIGS. 3 and 5, it is also possible to form averaged values, for example across the three last method sequences, so as to improve the accuracy of the method result. Furthermore, the response time of solenoid valve 72 may be determined from the onset of pressure drop dp in fluid reservoir 80.

In exemplary embodiments not shown here, the aforedescribed method is used with internal combustion engines having manifold injection and with diesel gasoline engines.

In an exemplary embodiment also not shown, in an operating phase in which discharge valve 20 is at rest, valve 118 is closed and the pressure development in fluid reservoir 80 is monitored. A message is output if the pressure drops too much during a particular time period. This may be an entry in a fault memory, or a warning display may light up for the user of internal combustion engine 10. It is also conceivable in such a case to shut down internal combustion engine 10 completely or to allow only a restricted operational safety operation so as to avoid further damage to internal combustion engine 10.

What is claimed is:

1. A method for operating a hydraulic actuator for a gas-exchange valve of an internal combustion engine, comprising:

selectively connecting and disconnecting, with the aid of a valve device, a working chamber of the actuator and a fluid reservoir, wherein a hydraulic fluid is stored under pressure the fluid reservoir, and wherein a lift of the actuating element of the actuator is dependent on a fluid volume present in the working chamber; and ascertaining an instantaneous operating performance of the actuator by: a) briefly connecting the working chamber to the fluid reservoir; b) recording a corresponding pressure drop in the fluid reservoir; c) determining a corresponding lift from the pressure drop in the fluid reservoir, with the aid of predetermined geometric variables of the actuator; and d) forming at least one value pair that includes the lift of the actuating element and an open duration time period during which the working chamber of the actuator is connected to the fluid reservoir.

2. The method as recited in claim 1, wherein the pressure drop in the fluid reservoir is recorded for a plurality of open duration time periods during which the working chamber of the actuator is connected to the fluid reservoir, a plurality of value pairs corresponding to the plurality of open duration time periods being formed, and wherein an instantaneous characteristic curve is formed from the plurality of value pairs.

3. The method as recited in claim 1, further comprising:

causing the actuating element to shift from a predetermined initial position to a predetermined limit position, and recording a corresponding reference pressure drop in the fluid reservoir; and standardizing the at least one value pair with the aid of the recorded reference pressure drop and a lift between the initial position and the limit position.

4. The method as recited in claim 3, wherein reaching of at least one of the predetermined initial position and the predetermined limit position of the actuating element is detected with the aid of a knock sensor.

5. The method as recited in claim 1, wherein the at least one value pair is formed taking into consideration at least one of elasticity of the hydraulic fluid and elasticity of the fluid reservoir.

6. The method as recited in claim 1, further comprising:

recording at least one of temperature and viscosity of the hydraulic fluid while determining the instantaneous operating performance of the actuator, wherein the at least one value pair is formed for the at least one of temperature and viscosity of the hydraulic fluid.

7. The method as recited in claim 1, further comprising:

determining a response time of the valve device from an onset of the pressure drop in the fluid reservoir.

8. The method as recited in claim 1, wherein, to ascertain the instantaneous operating performance of the hydraulic actuator, at least one of: a) the fluid reservoir is fluidly separated from a pressure reservoir; and b) a high-pressure pump for the supply of the fluid reservoir is shut off.

9. The method as recited in claim 1, wherein the instantaneous operating performance of the actuator is determined at least one of: a) after the internal combustion engine has been shut off; and b) during an overrun operation of the internal combustion engine.

10. The method as recited in claim 1, wherein the pressure in the fluid reservoir is detected when the hydraulic actuator is at rest, and wherein a signal is output if an impermissible pressure drop is detected.

11. A computer-readable storage medium storing a plurality of computer-executable codes for controlling, when executed by a computer, a method for operating a hydraulic actuator for a gas-exchange valve of an internal combustion engine, the method comprising:

selectively connecting and disconnecting, with the aid of a valve device, a working chamber of the actuator and a fluid reservoir, wherein a hydraulic fluid is stored under pressure the fluid reservoir, and wherein a lift of the actuating element of the actuator is dependent on a fluid volume present in the working chamber; and ascertaining an instantaneous operating performance of the actuator by: a) briefly connecting the working chamber to the fluid reservoir; b) recording a corresponding pressure drop in the fluid reservoir; c) determining a corresponding lift from the pressure drop in the fluid reservoir, with the aid of predetermined geometric variables of the actuator; and d) forming at least one value pair that includes the lift of the actuating element and an opening duration during which the working chamber of the actuator is connected to the fluid reservoir.

12. A control device for a hydraulic actuator for a gas-exchange valve of an internal combustion engine, comprising:

a control unit for controlling:

selectively connecting and disconnecting, with the aid of a valve device, a working chamber of the actuator and a fluid reservoir, wherein a hydraulic fluid is stored under pressure the fluid reservoir, and wherein a lift of the actuating element of the actuator is dependent on a fluid volume present in the working chamber; and ascertaining an instantaneous operating performance of the actuator by: a) briefly connecting the working chamber to the fluid reservoir; b) recording a corresponding pressure drop in the fluid reservoir; c) determining a corresponding lift from the pressure drop in the fluid reservoir, with the aid of predetermined geometric variables of the actuator; and d) forming at least one value pair that includes the lift of the actuating element and an opening duration during which the working chamber of the actuator is connected to the fluid reservoir.

* * * * *